US010584915B2

(12) United States Patent
Nelson

(10) Patent No.: US 10,584,915 B2
(45) Date of Patent: Mar. 10, 2020

(54) COMBINED MICROWAVE OVEN AND REFRIGERATOR APPLIANCE

(71) Applicant: Midea Group Co., Ltd., Foshan (CN)

(72) Inventor: Nathan Nelson, Louisville, KY (US)

(73) Assignee: MIDEA GROUP CO., LTD., Beijiao, Shunde, Foshan, Guangdong (CN)

( * ) Notice: Subject to any disclaimer, the term of this patent is extended or adjusted under 35 U.S.C. 154(b) by 328 days.

(21) Appl. No.: 15/637,894

(22) Filed: Jun. 29, 2017

(65) Prior Publication Data

US 2019/0003763 A1 Jan. 3, 2019

(51) Int. Cl.

| | |
|---|---|
| ***F25D 23/12*** | (2006.01) |
| ***H05B 6/64*** | (2006.01) |
| ***H01R 39/00*** | (2006.01) |
| *F25D 31/00* | (2006.01) |

(52) U.S. Cl.

CPC ..... *F25D 23/12* (2013.01); *H01R 39/00* (2013.01); *F25D 31/005* (2013.01)

(58) Field of Classification Search

CPC ..... F25D 23/12; F25D 31/005; H05B 6/64; H05B 6/80

USPC ..... 219/762

See application file for complete search history.

(56) References Cited

U.S. PATENT DOCUMENTS

| | | | | |
|---|---|---|---|---|
| D286,882 | S | 11/1986 | Hong | |
| 4,791,861 | A | 12/1988 | Weinkle et al. | |
| D368,482 | S | 4/1996 | Bone | |
| 5,521,359 | A | 5/1996 | Bone | |
| 5,765,796 | A * | 6/1998 | Lanus | A47B 11/00 248/349.1 |
| 5,775,665 | A | 7/1998 | Haskin et al. | |
| 7,338,139 | B2 | 3/2008 | Peter | |
| 8,742,304 | B2 | 6/2014 | Emma | |
| 9,049,925 | B1 * | 6/2015 | Winchester | B25H 1/10 |
| 2009/0188911 | A1 * | 7/2009 | Emma | H05B 6/66 219/679 |
| 2011/0300272 | A1 | 12/2011 | Smario | |
| 2016/0231029 | A1 | 8/2016 | Pan | |
| 2017/0059233 | A1 | 3/2017 | Estill et al. | |

FOREIGN PATENT DOCUMENTS

| | | | |
|---|---|---|---|
| CN | 201607089 | U | 10/2010 |
| CN | 104748478 | A | 7/2015 |
| CN | 205641775 | U | 10/2016 |
| EP | 2199715 | A2 | 6/2010 |
| ES | 1067354 | | 5/2008 |
| JP | H02169983 | A | 6/1990 |
| JP | 4312933 | B2 | 8/2009 |

OTHER PUBLICATIONS

Machine Translation of JP4312933 performed on Jul. 17, 2019.*

International Search Report and Written Opinion issued in Application No. PCT/CN2018/078747 dated May 24, 2018.

* cited by examiner

*Primary Examiner* — Brian W Jennison

(74) *Attorney, Agent, or Firm* — Middleton Reutlinger

(57) ABSTRACT

An apparatus having a microwave oven pivotally coupled with a refrigerator. The microwave oven may be locked in one or more pivot positions relative to the refrigerator. The pivot axis of the microwave oven may be in a variety of positions relative to the refrigerator and microwave to result in a variety of orientations.

15 Claims, 4 Drawing Sheets

COMBINED MICROWAVE OVEN AND REFRIGERATOR APPLIANCE

BACKGROUND

The present embodiments relate to a microwave oven integrated with a refrigerator appliance, and particularly, but not limited to, with a dorm refrigerator appliance.

Typical microwave ovens are separate appliances from refrigerators. Some microwave ovens are affixed to the top of the refrigerator appliance in a unitary configuration. Thus there is a need to allow the consumer to have a combined microwave oven and refrigerator in which the consumer can adjust the microwave oven to a variety of orientations relative to the refrigerator appliance in order to adapt to a variety of installations or applications.

SUMMARY

In some embodiments, for example, an apparatus may comprise a refrigerator having a body defining an opening with a door. Moreover, in some embodiments, the body may include a top surface. In various embodiments, the apparatus may comprise a microwave oven having a body defining an opening with a door. Moreover, in some embodiments, the body may include a bottom surface. In some embodiments, the apparatus may comprise a pivot mechanism coupling the top surface of the refrigerator and the bottom surface of the microwave oven. Moreover, in some embodiments, the pivot mechanism may allow the microwave oven to pivot about a pivot axis between a first pivot position and a second pivot position relative to the refrigerator.

In addition, in some embodiments, the body of the microwave oven may include a first central longitudinal axis and the body of the refrigerator includes a second central longitudinal axis. Moreover, in some embodiments, the first central longitudinal axis and the second central longitudinal axis may be substantially aligned in both the first pivot position and the second pivot position. In some embodiments, the first central longitudinal axis and the second central longitudinal axis may be substantially aligned in the first pivot position and may not substantially aligned in the second pivot position. In various embodiments, the pivot mechanism may be off-center from a central longitudinal axis of the refrigerator. In some embodiments, the apparatus may comprise a power supply to the microwave oven coupled with the pivot mechanism from the refrigerator to the microwave oven. In various embodiments, the apparatus may comprise a locking mechanism securing a position of the microwave oven relative to the refrigerator in at least one of the first pivot position and the second pivot position. In addition, in some embodiments, the locking mechanism may secure the position of the microwave oven relative to the refrigerator in both the first pivot position and the second pivot position. In various embodiments, the locking mechanism may include one or more detents.

In some embodiments, an apparatus may comprise a refrigerator having a body defining an opening with a door. In some embodiments, the apparatus may include a microwave oven having a body defining an opening with a door. Moreover, the microwave oven may be pivotally coupled to the refrigerator. In various embodiments, the microwave oven may pivot relative to the refrigerator between one or more pivot positions about a pivot axis. In some embodiments, the microwave oven may have a locking mechanism to secure the microwave oven in the one or more pivot positions relative to the refrigerator.

In addition, in some embodiments, the locking mechanism may include one or more detents corresponding to one or more pivot positions. In various embodiments, the pivot axis may be substantially vertical. In some embodiments, the pivot axis may be offset from a central longitudinal axis of the microwave oven. Moreover, in some embodiments, the apparatus may comprise a pivot mechanism extending between a bottom surface of the microwave oven body and a top surface of the refrigerator body. Moreover, in some embodiments, the apparatus may comprise a power supply to the microwave oven coupled with the pivot mechanism from the refrigerator to the microwave oven.

Some embodiments may include the method of accessing a microwave oven in a combined microwave oven and refrigerator apparatus comprising the step of providing a refrigerator with a body defining an opening with a door. In various embodiments, the method may include providing a microwave oven with a body defining an opening with a door, wherein the microwave oven may be pivotally coupled to the refrigerator. In addition, in some embodiments, the method may include pivoting the microwave oven from a first pivot position to a second pivot position about a pivot axis relative to the refrigerator, wherein when in the second pivot position the microwave oven door may be substantially unparallel to the refrigerator door.

In addition, in some embodiments, the method may include the pivot axis being substantially parallel to and spaced apart from a central longitudinal axis of the refrigerator. In various embodiments, the method may include the pivot axis being substantially coaxially aligned with a central longitudinal axis of the refrigerator. In some embodiments, the method may include the step of locking the orientation of the microwave oven relative to the refrigerator in at least one of the second pivot position and the first pivot position. In various embodiments, the method may include a pivot mechanism between the microwave oven and the refrigerator. In addition, in some embodiments, the method may include the step of supplying power to the microwave oven through a pivot mechanism from the refrigerator to the microwave oven.

These and other advantages and features, which characterize the embodiments, are set forth in the claims annexed hereto and form a further part hereof. However, for a better understanding of the embodiments, and of the advantages and objectives attained through its use, reference should be made to the Drawings and to the accompanying descriptive matter, in which there is described example embodiments. This summary is merely provided to introduce a selection of concepts that are further described below in the detailed description, and is not intended to identify key or essential features of the claimed subject matter, nor is it intended to be used as an aid in limiting the scope of the claimed subject matter.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Numerous variations and modifications will be apparent to one of ordinary skill in the art, as will become apparent from the description below. Therefore, the invention is not limited to the specific implementations discussed herein.

In the Figures, an apparatus 10 may include a microwave oven 20 integrated with a refrigerator appliance 30. As shown in the embodiments, the microwave oven 20 may be orientated relative to the refrigerator 30 in a variety of pivot positions. With the ability of user to reposition the microwave oven 20 in a variety of pivot positions relative to the refrigerator 30 for numerous applications or installations, the user may store the microwave oven 20 in a desired stowed position and/or deploy the microwave to a variety of orientations or operational positions. The apparatus 10 may be advantageous, but is not limited to, when available space adjacent the apparatus 10 is limited and/or when one or more operational and/or stowed positions of the microwave oven 20 is desired. It should be understood that the microwave oven 20 may be a variety of constructions, sizes, and shapes and still be within the scope of the invention. Moreover, it should be understood that the refrigerator 30 may be a variety of constructions, sizes, and shapes and still be within the scope of the invention. For example, the refrigerator 30 may be a dorm refrigerator as shown in the Figures.

Figure 1:
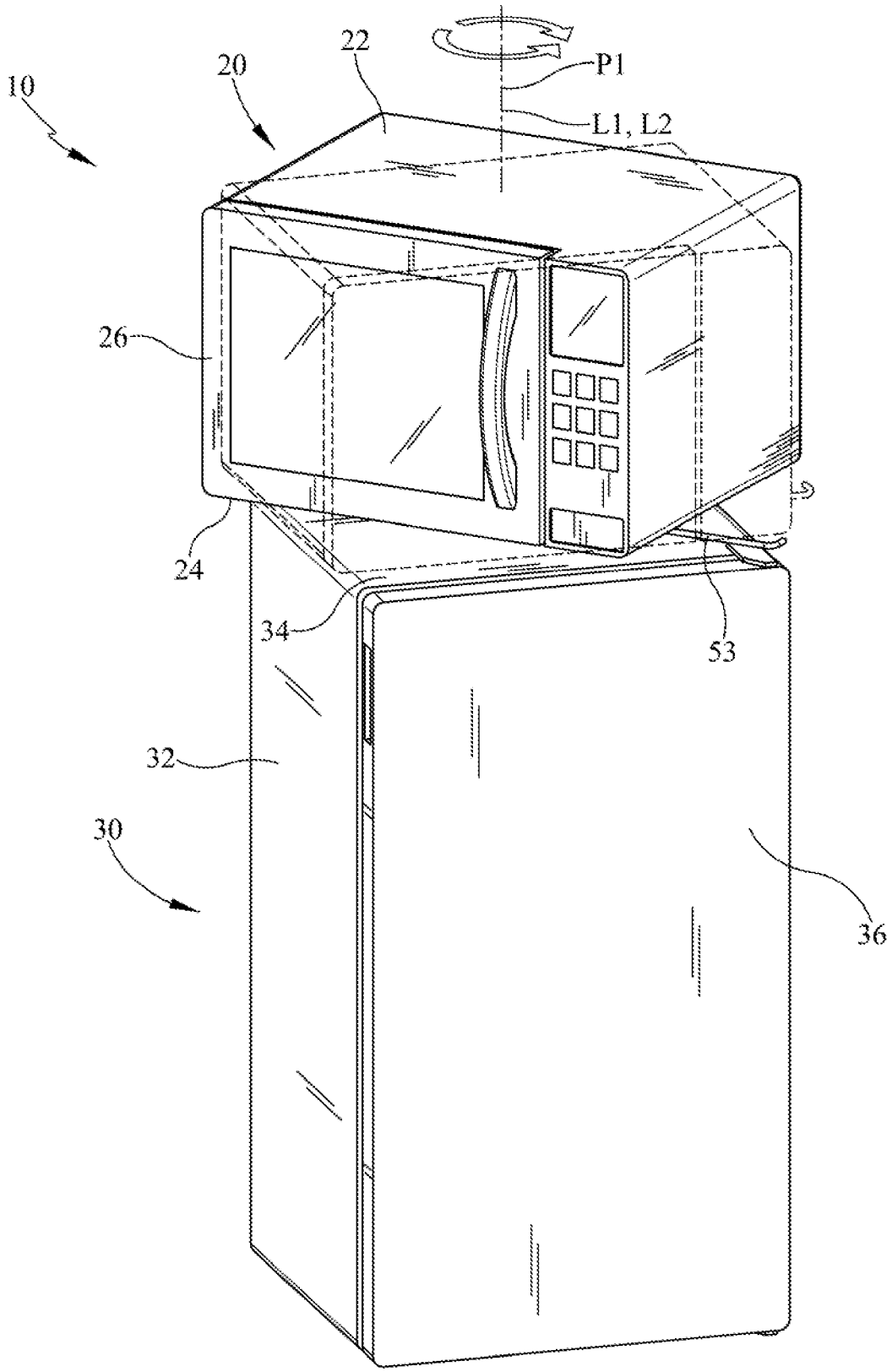
FIG. 1 is a perspective view of an embodiment of a microwave oven and refrigerator appliance, the microwave oven is illustrated in broken lines in a first pivot position and solid lines in a second pivot position about a first pivot axis.
Figure 2:
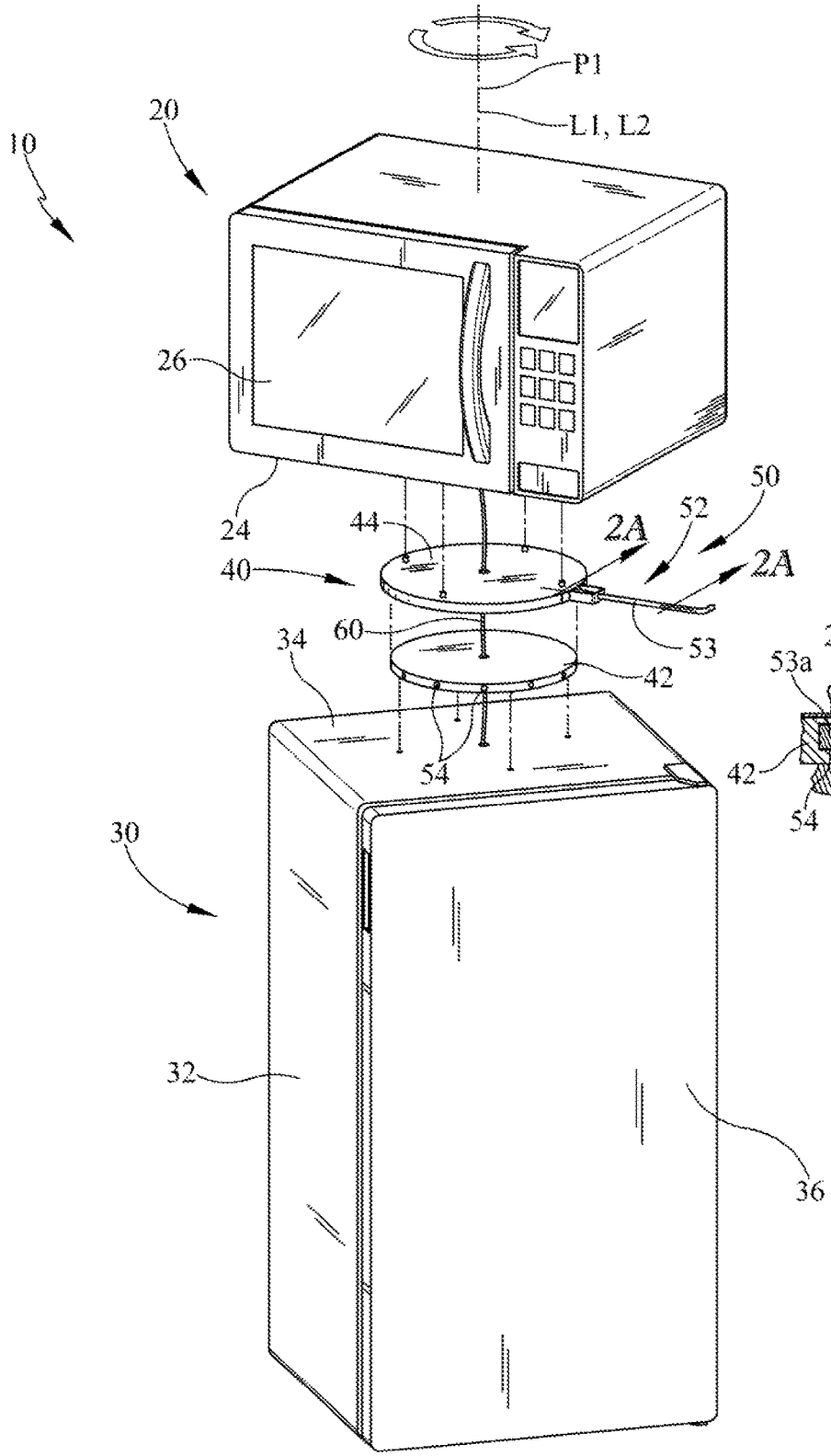
FIG. 2 is an exploded view of the microwave oven and refrigerator of FIG. 1, illustrating an embodiment of a pivot mechanism between the microwave oven and the refrigerator.
Figure 3:
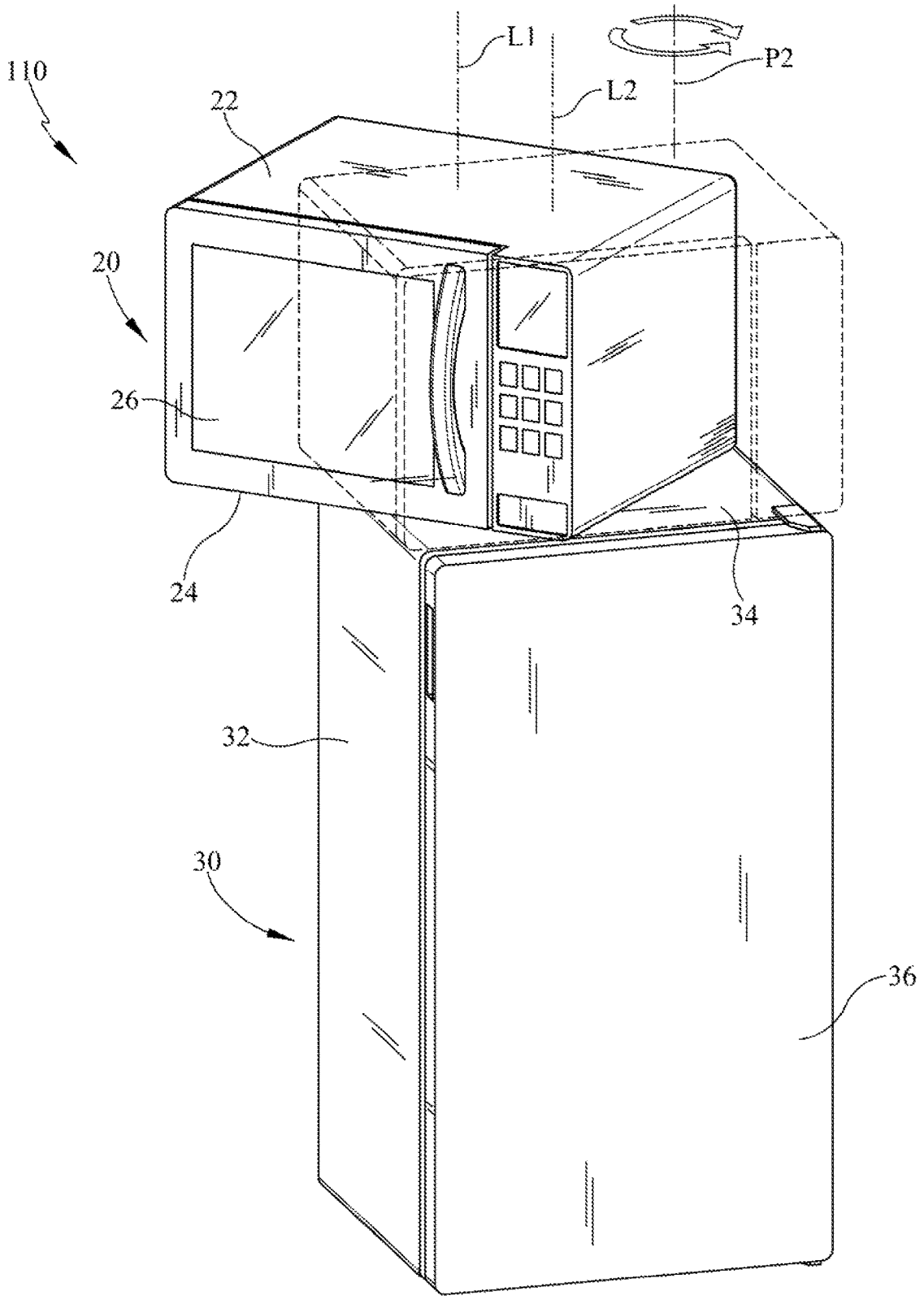
FIG. 3 is a perspective view of another embodiment of a microwave oven and refrigerator appliance, the microwave oven is illustrated in broken lines in a first pivot position and solid lines in a second pivot position about a second pivot axis different from the first pivot axis of FIG. 1.
Figure 4:
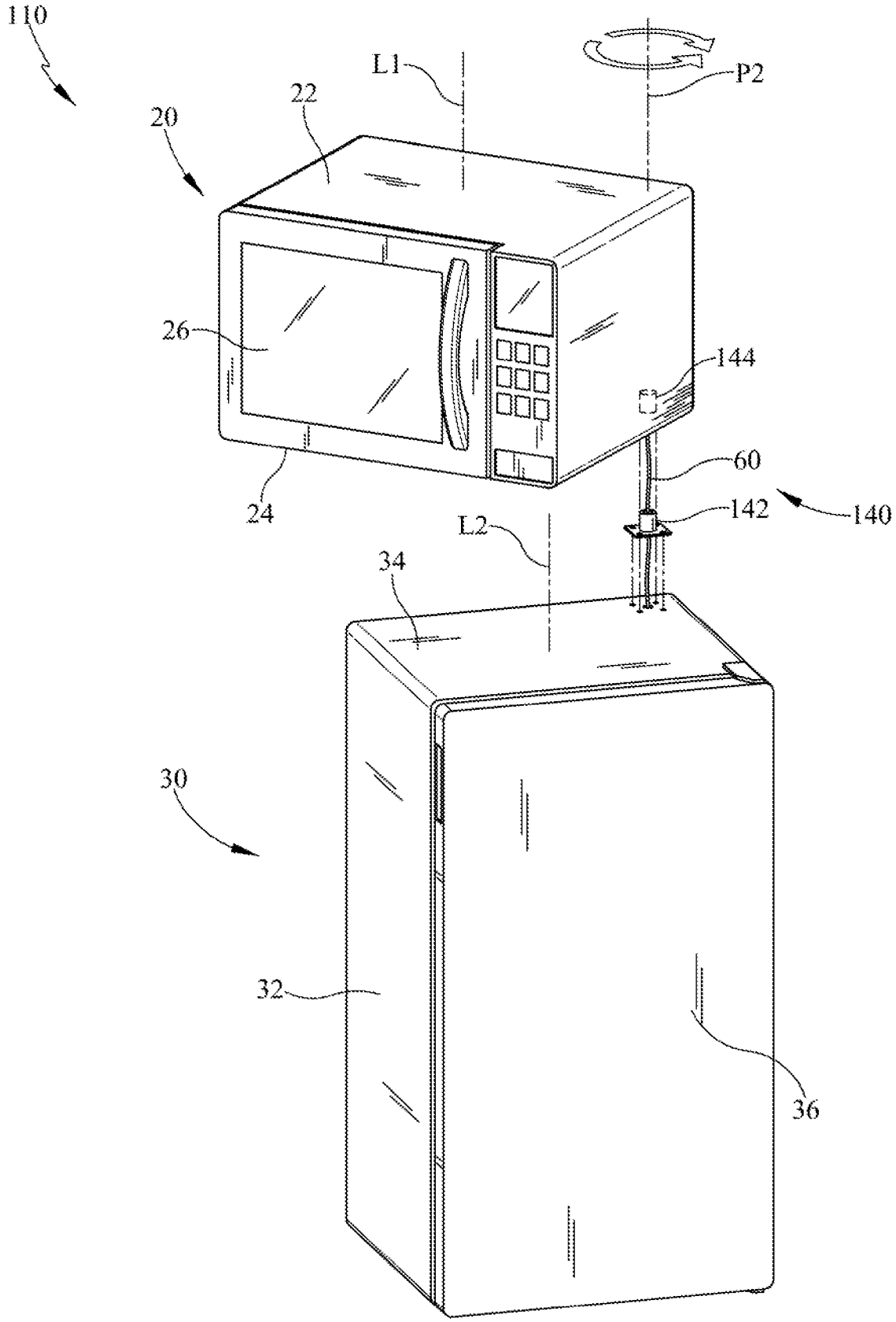
FIG. 4 is an exploded view of the microwave oven and refrigerator of FIG. 3, illustrating another embodiment of a pivot mechanism between the microwave oven and the refrigerator.

As illustrated, the microwave oven 20 is pivotally coupled to the refrigerator 30 about a pivot axis. The pivot axis of the microwave oven 20 may be in a variety of locations relative to the microwave oven 20 and/or the refrigerator 30 to obtain a variety of relative orientations and/or motion between the microwave oven 20 and refrigerator 30. For example, in some embodiments such as shown in FIGS. 1 and 2, the pivot axis P1 may be substantially coaxially aligned with a central axis of the microwave oven 20 and/or the refrigerator 30. Moreover, in various embodiments such as shown in FIGS. 3 and 4, the pivot axis P2 may be offset from, misaligned with, or off-center from at least one of the longitudinal or central axis of the microwave oven 20 and refrigerator 30. In some embodiments, the pivot axis may be substantially vertical.

In the embodiment shown in FIGS. 1 and 2, a first pivot axis P1 is substantially aligned with the longitudinal or central axis of both the microwave oven 20 (L1) and the refrigerator 30 (L2). As a result, the longitudinal axis L1, L2 of each one of the microwave oven 20 and the refrigerator 30, respectively, is substantially aligned in both the first pivot position (shown in broken lines in FIG. 1) and the second pivot position (shown in solid lines in FIGS. 1 and 2). The microwave oven 20 shown in FIG. 1 may be described as having a concentric pivot or motion relative to the refrigerator 30.

In the embodiment shown in FIGS. 3 and 4, a second pivot axis P2 is spaced away from both the longitudinal axis L1 of the microwave oven 20 and the longitudinal axis L2 of the refrigerator 30. As a result, the longitudinal axis L of the microwave oven 20 and the longitudinal axis L2 of the refrigerator 30 are substantially aligned in the first pivot position (shown in broken lines in FIG. 3) and are not substantially aligned in the second pivot position (shown in solid lines in FIGS. 3 and 4). The microwave oven shown in FIG. 3 may be described as having an eccentric pivot or motion relative to the refrigerator 30. Although not shown, it should be understood that the pivot axis may be aligned with refrigerator longitudinal axis L2 but not with the microwave longitudinal axis L1 to provide a variety of pivot positions/orientations or motions of the microwave oven 20 in relation to the refrigerator 30.

The microwave oven 20 may pivot about the pivot axis P1, P2 relative to the refrigerator by a variety of pivot mechanisms 40, 140. The pivot mechanism 40, 140 may allow the microwave oven 20 to pivot about the pivot axis between the first pivot position and the second pivot position relative to the refrigerator 30. The pivot mechanism may allow pivoting 360 degrees about the pivot axis to one or more pivot positions, such as for example in the desired stowed and/or operational positions. In some embodiments, the pivot mechanism may limit the range of pivotability between a range of positions, such as but not limited to 45, 90, 135, and 180 degrees. It should be understood that the degree of motion between pivot positions may be equal therebetween in some embodiments. In various embodiments, the degree of motion between pivot positions may not be equal. Further, the microwave oven 20 may pivot clockwise and/or counterclockwise. It should be understood that the pivot mechanism may be a variety of constructions, shapes, sizes, orientations, and locations relative to the microwave oven and refrigerator and still be within the scope of the invention. For example, some embodiments of the pivot mechanism may include one or more bearings and/or sliding contact surface. Although other relative positions should be understood, the microwave oven body 22 may be stacked on top of or disposed above the refrigerator body 32 and pivotally coupled. The microwave oven 20 may be substantially centrally located above the refrigerator 30 in at least one pivot position, such as for example the stowed position. As shown in the embodiments, the pivot mechanisms 40, 140 may extend between or couple a top surface 34 of the refrigerator body 32 to a bottom surface 24 of the microwave oven body 22. In various embodiments, it is contemplated that the pivot mechanism may couple to a variety of the surfaces of the bodies of both of the microwave oven 20 and refrigerator 30 and still be within the scope of the invention.

As shown in FIGS. 1 and 2, one embodiment of the pivot mechanism 40 is substantially centrally located along at least one of the longitudinal axes L1, L2 of the microwave oven 20 and the refrigerator 30, respectively. The swivel or base of the pivot mechanism 40 as shown in FIG. 2 may include a lower base 42 coupled to top surface 34 of the refrigerator 30 and an upper base 44 coupled to the bottom surface 24 of the microwave oven 20. To allow the apparatus 10 to pivot to one or more desired positions, the lower base 42 adjacent the top surface 34 of the refrigerator 30 may be rotatably received with the upper base 44 adjacent the microwave bottom surface 24 to allow rotation. As a result, in some embodiments, the upper base 44 may rotate with the microwave oven 20 relative to the lower base 42 and refrigerator 30.

Figure 2A:
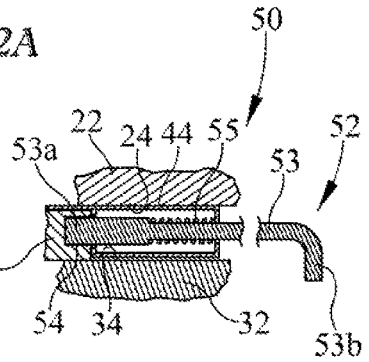
FIG. 2A is a sectional view of an embodiment of a locking mechanism of FIG. 2 taken along line 2A-2A.

In addition, in some embodiments, one or more locking mechanisms may be used to secure the position of the microwave oven in one or more pivot positions. A locking mechanism 50 may be used to lock the movement of the appliance or apparatus 10. The locking mechanism 50, if used in an embodiment, may be used to lock the position of the microwave oven 20 in the first pivot position and/or the second pivot position, or in any other desired position. As shown more clearly in FIGS. 2 and 2A, one embodiment of the locking mechanism 50 may be one or more detents 52. The detent 52 shown in FIGS. 2 and 2A includes a spring loaded pin 53 biased through a lateral opening in the upper base 44 such that a distal end 53*a* of the pin 53 operably and selectively engages a plurality of spaced pin receiving openings 54 within the lower base 42. A spring 55 may urge the pin 53 to return to the pin receiving opening 54. The one or more pin receiving openings 54 correspond to one or more pivot positions of the microwave oven 20 and/or upper base 44. In use, when the distal end 53*a* of the pin 53 is engaged/biased into at least one pin receiving opening 54 the microwave may be locked in a particular position (e.g. stowed position or pivot position). When the user pulls radially outward on a proximal end or handle/lever 53*b* of the pin, the pin 53 is disengaged from the pin receiving opening 54 thereby allowing the microwave oven 20 to be pivoted or orientated to another pivot position (e.g. deployed position). Once the upper base 44 has rotated and lined up another pin receiving opening 54 of the lower base 42, the spring 55 urges the pin 53 back into engagement with the pin receiving opening 54 thereby preventing further rotation. It should be understood that the locking mechanism may be a variety of constructions, shapes, sizes, orientations, and locations within the apparatus and still be within the scope of the embodiments. For example, although the pivot mechanism 40 may include the locking mechanism 50 as shown in FIGS. 1, 2, and 2A, it should be understood that the locking mechanism, if used, may be separate from the pivot mechanism in some embodiments. Moreover, the detent 52 may not have to be manually disengaged in some embodiments. For example, in some embodiments a handle may not be needed to release the catch, the locking mechanism catch may be a spring loaded ball engaging with one or more arcuately spaced slots or depressions corresponding to a variety of pivot positions such that a threshold amount of rotational force on the microwave will result in the ball temporarily sliding/biasing out of engagement with one pivot position and/or slot and automatically engaging the next adjacent slot upon further rotation of the microwave oven.

As shown in FIGS. 3 and 4, another embodiment of the pivot mechanism 140 pivotally couples the bottom surface 24 of the microwave oven 20 to the top surface 34 of the refrigerator 30 at a location off-center or spaced from the longitudinal axis L2 of the refrigerator. As shown in FIG. 4, the pivot mechanism 140 may be in the form of a mating male and female structure to allow the apparatus 110 to pivot to a desired position. A male pin 142 projecting from the top surface 34 of the refrigerator 30 is rotatably received within a female connector 144 of the microwave bottom surface 24 to allow rotation of the appliances therebetween. Although the apparatus 110 in FIGS. 3 and 4 does not show a locking mechanism, a locking mechanism may be used in some embodiments.

In addition, in some embodiments, the apparatus 10, 110 may include a power supply 60 to the microwave oven 20 integrated with the refrigerator 30. Alternatively, the power supply to the microwave oven 20 may be separate from the refrigerator 30 in some embodiments. As shown more clearly in FIGS. 2 and 4, the power supplied to the microwave oven 20 is coupled to the refrigerator 30 through the pivot mechanisms 40, 140. The power supply 60 may be coupled to the pivot mechanism 40 as shown in FIG. 2, more specifically the power supply 60 may pass through the upper base 44 and lower base 42. As shown in FIG. 4, the power supply 60 may pass through the female connector 144 and the male pin 142 from the refrigerator 30 to the microwave oven 20. It should be understood that the power supplied to the microwave may be a variety of constructions, shapes, sizes, quantities, orientations, and locations within the apparatus and still be within the scope of the invention.

Some embodiments of the apparatus advantageously may allow the manufacturer and/or consumer several benefits. In some embodiments, the microwave oven 20 may be positioned in the stowed or first pivot position and subsequently pivoted to a deployed or second pivot position. The body 22 of the microwave oven 20 may define an opening with a door 26 as shown in the Figures. Further, the body 32 of the refrigerator 30 may define an opening with a door 36. As shown in the FIGS. 2 and 4, in some embodiments, when the microwave oven 20 is in the deployed position the microwave oven door 26 may be unparallel to the refrigerator door 36. Further in various embodiments shown in the figures, when the microwave oven 20 is in the stowed position (shown as broken lines in FIGS. 1 and 3) the microwave oven door 26 may be substantially parallel to the refrigerator door 36, in or out of the same plane. A stowed position may allow the apparatus to be shipped and/or packaged for shipping. A consumer may desire to pivot the microwave oven 20 to the deployed position or subsequently return the microwave oven 20 to the stowed position after operation of the microwave oven 20 in some applications. The pivoting of the microwave oven 20 may allow one or more consumers the ability to orientate the microwave oven door 26 as desired for an installation. The consumer may pivot the microwave oven 20 to a variety of deployed and/or stowed positions to accommodate space-limited areas. For example, in some embodiments, the consumer may be able to pivot the microwave oven into a cabinet 20 when not in use or out of the cabinet to operate. Moreover, in some embodiments, the apparatus may have multiple mounting locations in one or both of the microwave oven 20 and refrigerator 30 to mount the pivot mechanism 40, 140. As a result of having multiple mounting locations for the pivot mechanism 40, 140, this may allow for the consumer and/or manufacturer to select and/or change the desired pivot axis or pivot motion (e.g. concentric or eccentric pivot motion) for an application.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

It is to be understood that the embodiments are not limited in its application to the details of construction and the arrangement of components set forth in the description or illustrated in the drawings. The invention is capable of other embodiments and of being practiced or of being carried out in various ways. Unless limited otherwise, the terms "connected," "coupled," "in communication with," and "mounted," and variations thereof herein are used broadly and encompass direct and indirect connections, couplings, and mountings. In addition, the terms "connected" and "coupled" and variations thereof are not restricted to physical or mechanical connections or couplings.

The foregoing description of several embodiments of the invention has been presented for purposes of illustration. It is not intended to be exhaustive or to limit the invention to the precise steps and/or forms disclosed, and obviously many modifications and variations are possible in light of the above teaching.

The invention claimed is:

1. An apparatus comprising:

a refrigerator having a body defining an opening with a door, and wherein the body includes a top surface;

a microwave oven having a body defining an opening with a door, and wherein the body includes a bottom surface; and a pivot mechanism coupling the top surface of the refrigerator and the bottom surface of the microwave oven, wherein the pivot mechanism on the top surface of the refrigerator is off-center from a central longitudinal axis of the body of the refrigerator, and wherein the pivot mechanism allows the microwave oven to pivot about a pivot axis between a first pivot position and a second pivot position relative to the refrigerator.

2. The apparatus of claim 1 wherein the body of the microwave oven includes a second central longitudinal axis and the body of the refrigerator includes the central longitudinal axis, wherein the second central longitudinal axis of the microwave oven and the central longitudinal axis of the refrigerator are substantially aligned in the first pivot position and not substantially aligned in the second pivot position.

3. The apparatus of claim 1 further comprising a power supply to the microwave oven coupled with the pivot mechanism from the refrigerator to the microwave oven.

4. The apparatus of claim 1 further comprising a locking mechanism securing a position of the microwave oven relative to the refrigerator in at least one of the first pivot position and the second pivot position.

5. The apparatus of claim 4 wherein the locking mechanism secures the position of the microwave oven relative to the refrigerator in both the first pivot position and the second pivot position.

6. The apparatus of claim 4 wherein the locking mechanism includes one or more detents.

7. An apparatus comprising:

a refrigerator having a body defining an opening with a door;

a microwave oven having a body defining an opening with a door, the body of the microwave oven being pivotally coupled to a top surface of the body of the refrigerator offset from a central longitudinal axis of the refrigerator;

wherein the microwave oven pivots relative to the refrigerator between one or more pivot positions about a pivot axis, and wherein the pivot axis is offset from the central longitudinal axis of the refrigerator; and the microwave oven having a locking mechanism to secure the microwave oven in the one or more pivot positions relative to the refrigerator.

8. The apparatus of claim 7 wherein the locking mechanism includes one or more detents corresponding to one or more pivot positions.

9. The apparatus of claim 7 wherein the pivot axis is substantially vertical.

10. The apparatus of claim 7 wherein the pivot axis is offset from a central longitudinal axis of the microwave oven.

11. The apparatus of claim 7 further comprising a pivot mechanism extending between a bottom surface of the microwave oven body and the top surface of the refrigerator body.

12. The apparatus of claim 11 further comprising a power supply to the microwave oven coupled with the pivot mechanism from the refrigerator to the microwave oven.

13. A method of accessing a microwave oven in a combined microwave oven and refrigerator apparatus comprising the steps of:

providing a refrigerator with a body defining an opening with a door;

providing a microwave oven with a body defining an opening with a door, wherein the microwave oven is pivotally coupled to the refrigerator, and a pivot mechanism coupled between the body of the microwave oven and the body of the refrigerator, wherein the pivot mechanism defines a pivot axis, and wherein the pivot axis is substantially parallel to and spaced apart from a central longitudinal axis of the refrigerator;

pivoting the microwave oven relative to the refrigerator from a first pivot position to a second pivot position about the pivot axis defined by the pivot mechanism, wherein when in the second pivot position the microwave oven door is substantially unparallel to the refrigerator door.

14. The method of claim 13 further comprising locking the orientation of the microwave oven relative to the refrigerator in at least one of the second pivot position and the first pivot position.

15. The method of claim 13 further comprising supplying power to the microwave oven through the pivot mechanism from the refrigerator to the microwave oven.

* * * * *